US010287879B2

(12) United States Patent
Sharma et al.

(10) Patent No.: US 10,287,879 B2
(45) Date of Patent: May 14, 2019

(54) SYSTEMS AND METHODS FOR DOWNHOLE FLUID ANALYSIS

(71) Applicant: Schlumberger Technology Corporation, Sugar Land, TX (US)

(72) Inventors: Shivam Sharma, Navi Mumbai (IN); Sameer Joshi, Powai Mumbai (IN); Arjit Gidwani, Navi Mumbai (IN)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 359 days.

(21) Appl. No.: 15/199,143

(22) Filed: Jun. 30, 2016

(65) Prior Publication Data

US 2018/0003047 A1 Jan. 4, 2018

(51) Int. Cl.

| | |
|---|---|
| ***E21B 49/08*** | (2006.01) |
| ***E21B 49/00*** | (2006.01) |
| ***E21B 33/12*** | (2006.01) |
| ***E21B 47/06*** | (2012.01) |

(52) U.S. Cl.

CPC ..... *E21B 49/082* (2013.01); *E21B 33/12* (2013.01); *E21B 47/06* (2013.01); *E21B 49/00* (2013.01)

(58) Field of Classification Search

CPC ..... E21B 49/082; E21B 49/00; E21B 33/12; E21B 47/06; E21B 49/10; E21B 2049/085

See application file for complete search history.

(56) References Cited

U.S. PATENT DOCUMENTS

| | | | | |
|---|---|---|---|---|
| 4,860,581 | A | 8/1989 | Zimmerman et al. | |
| 4,936,139 | A | 6/1990 | Zimmerman et al. | |
| 5,269,180 | A | 12/1993 | Dave et al. | |
| 6,467,544 | B1 * | 10/2002 | Brown | E21B 49/082 166/167 |
| 7,243,536 | B2 * | 7/2007 | Bolze | E21B 49/081 166/264 |
| 7,296,462 | B2 | 11/2007 | Gregory | |
| 8,245,781 | B2 * | 8/2012 | Ciglenec | E21B 49/10 166/264 |
| 2004/0000400 | A1 * | 1/2004 | Fujisawa | E21B 47/1015 166/250.01 |

* cited by examiner

*Primary Examiner* — Michael R Wills, III
(74) *Attorney, Agent, or Firm* — Michael Dae

(57) ABSTRACT

The present disclosure relates to a system that includes a downhole tool that includes a packer module with an inlet disposed between an upper packer and a lower packer configured to seal an interval of a wellbore. The inlet is configured to admit a formation fluid disposed in the interval. The downhole tool also includes a pump out module, a fluid analysis module, and a sample module including a sample chamber containing an external fluid. The downhole tool also includes a data processing system configured to identify a composition of the formation fluid and includes one or more tangible, non-transitory, machine-readable media including instructions to identify a condition indicating stopping the pump out module, transfer the external fluid from the sample chamber to the interval the inlet, resume pumping of the formation fluid from the inlet via the pump out module, and output the composition of the formation fluid.

17 Claims, 5 Drawing Sheets

SYSTEMS AND METHODS FOR DOWNHOLE FLUID ANALYSIS

BACKGROUND OF THE DISCLOSURE

Wellbores or boreholes may be drilled to, for example, locate and produce hydrocarbons. During a drilling operation, it may be desirable to evaluate and/or measure properties of encountered formations and formation fluids. In some cases, a drillstring is removed and a wireline tool deployed into the borehole to test, evaluate and/or sample the formations and/or formation fluid(s). In other cases, the drillstring may be provided with devices to test and/or sample the surrounding formations and/or formation fluid(s) without having to remove the drillstring from the borehole.

Formation evaluation may involve drawing fluid from the formation into a downhole tool for testing and/or sampling. Various devices, such as probes and/or packers, may be extended from the downhole tool to isolate a region of the wellbore wall, and thereby establish fluid communication with the subterranean formation surrounding the wellbore. Fluid may then be drawn into the downhole tool using the probe and/or packer. Within the downhole tool, the fluid may be directed to one or more fluid analyzers and sensors that may be employed to detect properties of the fluid while the downhole tool is stationary within the wellbore.

SUMMARY

The present disclosure relates to a system that includes a downhole tool that includes a packer module. The packer module includes an upper packer and a lower packer configured to seal an interval of a wellbore in a geological formation, and an inlet disposed between the upper packer and the lower packer. The inlet is configured to admit a formation fluid disposed in the interval into a flow line of the downhole tool. The downhole tool also includes a pump out module configured to pump the formation fluid from the inlet, a fluid analysis module configured to analyze the formation fluid pumped to the fluid analysis module via the pump out module, a sample module including a sample chamber containing an external fluid, a flow line coupled to the packer module, pump out module, fluid analysis module, and sample module, and a data processing system configured to identify a composition of the formation fluid. The data processing system includes one or more tangible, non-transitory, machine-readable media including instructions to identify a condition indicating stopping the pump out module, transfer the external fluid from the sample chamber to the interval via the flowline and the inlet, resume pumping of the formation fluid from the inlet via the pump out module, and output the composition of the formation fluid.

The present disclosure also relates to a method including placing a downhole tool in a wellbore in a geological formation. The wellbore or the geological formation, or both, contain a formation fluid, and the downhole tool includes a packer module. The packer module includes an upper packer and a lower packer configured to seal an interval of the wellbore, and an inlet disposed between the upper packer and the lower packer. The inlet is configured to admit the formation fluid disposed in the interval into a flow line of the downhole tool. The downhole tool also includes a pump out module configured to pump the formation fluid from the inlet, a fluid analysis module configured to analyze the formation fluid pumped to the fluid analysis module via the pump out module, a sample module including a sample chamber containing an external fluid, and a flow line coupled to the packer module, pump out module, fluid analysis module, and sample module. The method also includes performing downhole fluid analysis using the fluid analysis module to determine a composition of the formation fluid and using a processor to identify a condition indicating that pumping by the pump out module is to be stopped, stop pumping by the pump out module, transfer the external fluid from the sample chamber to the interval via the flowline and the inlet, resume pumping of the formation fluid from the inlet via the pump out module, and output the composition of the formation fluid as determined by the fluid analysis module.

The present disclosure also relates to one or more tangible, non-transitory, machine-readable media including instructions to receive at least one measurement representative of a formation fluid as analyzed by a downhole tool in a wellbore in a geological formation within a hydrocarbon reservoir. The downhole tool includes a packer module. The packer module includes an upper packer and a lower packer configured to seal an interval of the wellbore, and an inlet disposed between the upper packer and the lower packer. The inlet is configured to admit the formation fluid disposed in the interval into a flow line of the downhole tool. The downhole tool also includes a pump out module configured to pump the formation fluid from the inlet, a fluid analysis module configured to analyze the formation fluid pumped to the fluid analysis module via the pump out module, a sample module including a sample chamber containing an external fluid, and a flow line coupled to the packer module, pump out module, fluid analysis module, and sample module. The one or more tangible, non-transitory, machine-readable media also include instructions to identify a condition indicating that pumping by the pump out module is to be stopped, stop pumping by the pump out module, transfer the external fluid from the sample chamber to the interval via the flowline and the inlet, resume pumping of the formation fluid from the inlet via the pump out module, and output the composition of the formation fluid as determined by the fluid analysis module.

BRIEF DESCRIPTION OF THE DRAWINGS

The present disclosure is understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
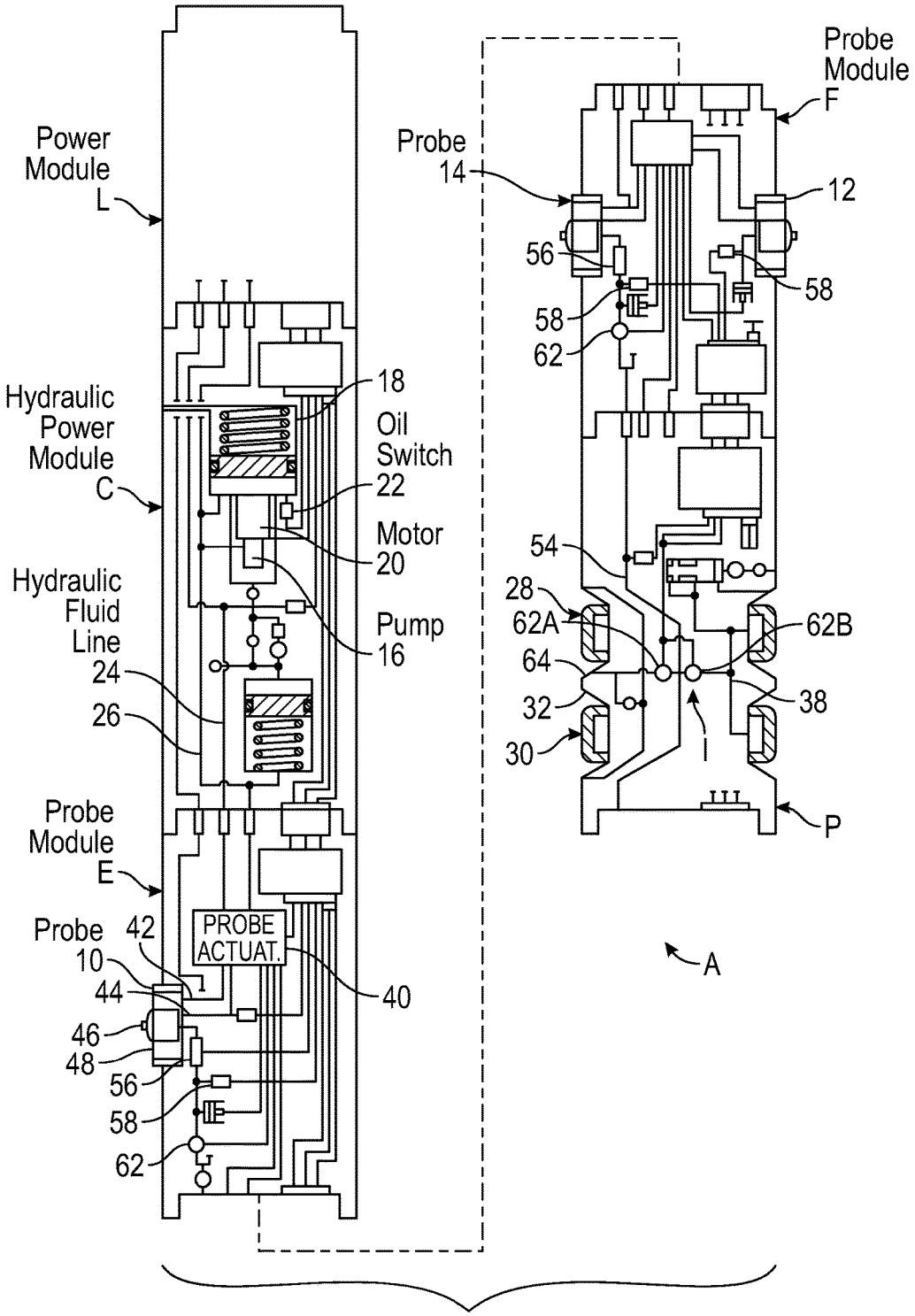
FIG. 1 is a schematic view of portions of an apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

The present disclosure relates to systems and methods for downhole fluid analysis (DFA), such DFA used with a downhole tool disposed in a wellbore. In certain embodiments, the downhole tool includes a plurality of modules coupled to one another. One of the modules may be a packer module that includes an upper packer and a lower packer to seal an interval of the wellbore. The packer module also includes an inlet disposed between the packers to admit a formation fluid disposed in the interval into a flow line of the downhole tool. The flow line may be fluidly coupled to the modules of the downhole tool, such as the packer module, a pump out module, a fluid analysis module, and a sample module. The downhole tool may also include a data processing system to control or operate one or more aspects of the downhole tool.

In certain embodiments, the data processing system may include instructions to stop pumping by the pump out module, transfer external fluid stored in a sample chamber of the sample module into the interval, and resume pumping by the pump out module. This procedure may be used when the formation adjacent the interval is a low mobility or tight reservoir. Such reservoirs may be stimulated (e.g., via hydraulic fracturing) to be able to produce at commercial flow rates. In addition, the flow rate of formation fluids entering the interval may be slow, causing the time for conducting an accurate DFA to be lengthy. In addition, the concentration of formation fluids may be small compared to the quantity of mud (e.g., water based mud (WBM), oil based mud (OBM) or synthetic oil based mud (SOBM)) present in the interval, making accurate DFA difficult. These challenges associated with low mobility reservoirs may be at least partially overcome by transferring a compatible external fluid into the interval, as described in further detail below. In particular, this recharging of the interval with the external fluid helps increase the interval pressure and improves the ability of the DFA to detect trace quantities of hydrocarbons, as described below.

As shown in FIG. 1, the apparatus A of the present disclosure has power module L, a hydraulic power module C. a packer module P and a probe module E. Probe module E is shown with one probe assembly 10 which is used for isotropic permeability tests. When using the tool to determine anisotropic permeability and the vertical reservoir structure, a multiprobe module F can be added to probe module E. Muitiprobe module F has a horizontal probe assembly 12 and a sink probe assembly 14

The hydraulic power module C includes a pump 16, reservoir 18 and a motor 20 to control the operation of the pump. A low oil switch 22 also forms part of the control system and is used in regulating the operation of pump 16. It should be noted that the operation of the pump can be controlled by pneumatic or hydraulic means.

A hydraulic fluid line 24 is connected to the discharge of pump 16 and runs through hydraulic power module C and into adjacent modules for use as a hydraulic power source. In the embodiment shown in FIG. 1, hydraulic fluid line 24 extends through hydraulic power module C into packer module P and probe module E or F depending upon which one is used. The loop is closed by virtue of hydraulic fluid line 26, which in FIG. 1 extends from probe module E back to hydraulic power module C where it terminates at reservoir 18.

The pump out module M can be used to dispose of unwanted samples by virtue of pumping the flow line 54 into the bore hole or may be used to pump fluids from the borehole into the flow line 54 to inflate straddle packers 28 and 30. Pump 92 can be aligned to draw from flow line 54 and dispose of the unwanted sample through flow line 95, as shown on FIG. 2 or may be aligned to pump fluid from the borehole (via flow line 95) to flow line 54. The pump out module M has the necessary control devices to regulate pump 92 and align fluid line 54 with fluid line 95 to accomplish the pump out procedure. It should be noted that samples stored in sample chamber modules S can also be pumped out of the apparatus A using pump out module M.

Alternatively, straddle packers 28 and 30 can be inflated and deflated with hydraulic fluid from pump 16. As can readily be seen, selective actuation of the pump out module M to activate pump 92 combined with selective operation of control valve 96 and inflation and deflation means I, can result in selective inflation or deflation of packers 28 and 30. Packers 28 and 30 are mounted to the outer periphery 32 of the apparatus A. The packers 28 and 30 are preferably constructed of a resilient material compatible with well bore fluids and temperatures. The packers 28 and 30 have a cavity therein. When pump 92 is operational and inflation means I are properly set, fluid from flow line 54 passes through inflation/deflation means I, and through flow line 38 to packers 28 and 30.

As also shown in FIG. 1, the probe module E has probe assembly 10 which is selectively movable with respect to the apparatus A. Movement of probe assembly 10 is initiated by virtue of the operation of probe actuator 40. The probe actuator 40 aligns flow line 24 and 26 with flow lines 42 and 44. As seen in FIG. 1, the probe 46 is mounted to a frame 48. Frame 48 is movable with respect to the apparatus A and probe 46 is movable with respect to frame 48. These relative movements are initiated by controller 40 by directing fluid from flow lines 24 and 26 selectively into flow lines 42 and 44 with the result being that the frame 48 is initially outwardly displaced into contact with the borehole wall. The extension of frame 48 helps to steady the tool during use and brings probe 46 adjacent the borehole wall.

Permeability measurements can be made by a multi probe module F lowering the apparatus A into the borehole and inflating packers 28 and 30. It should be noted that such measurements can be accomplished using the probe modules E or E and F without packer module P. The probe 46 is then set into the formation as described above. It should be noted that a similar procedure is followed when using multiprobe module F and probe module E which contain vertical probe 46 and horizontal probe 12 and sink probe 14.

Having inflated packers 28 and 30 and/or set probe 46 and/or probes 46, 12 and 14, the testing of the formation can begin. A sample flow line 54 extends from the outer periphery 32 at a point between packers 28 and 30, through adjacent modules and into the sample modules S. Vertical probe 46 and sink probe 14 allow entry of formation fluids into the sample flow line 54 via a resistivity measurement cell a pressure measurement device and a pretest mechanism. Horizontal probe 12 allows entry of formation fluids into a pressure measurement device and pretest mechanism. When using module E or E and F, isolation valve 62 is mounted downstream of resistivity sensor 56. In the closed position, isolation valve 62 limits the internal flow line volume, improving the accuracy of dynamic measurements made by pressure gage 58. After initial pressure tests are made, isolation valve 62 can be opened to allow flow into other modules When taking initial samples, there is a high prospect that the first fluid obtained is contaminated with mud cake and filtrate. It is desirable to purge such contaminants from the sample to be taken. Accordingly, the pumpout module M is used to initially purge from the apparatus A specimens of formation fluid taken through inlet 64 or vertical probe 46 or sink probe 14 to flow line 54. After having suitably flushed out the contaminants from the apparatus A, formation fluid can continue to flow through sample flow line 54 which extends through adjacent modules such as precision pressure module B, fluid analysis module D, pump out module M (FIG. 2), flow control module N and any number of sample chamber modules S which may be attached. By having a sample flow line 54 running the longitudinal length of various modules, multiple sample chamber modules S can be stacked without necessarily increasing the overall diameter of the tool. The tool can take that many more samples before having to be pulled to the surface and can be used in smaller bores.

Figure 2:
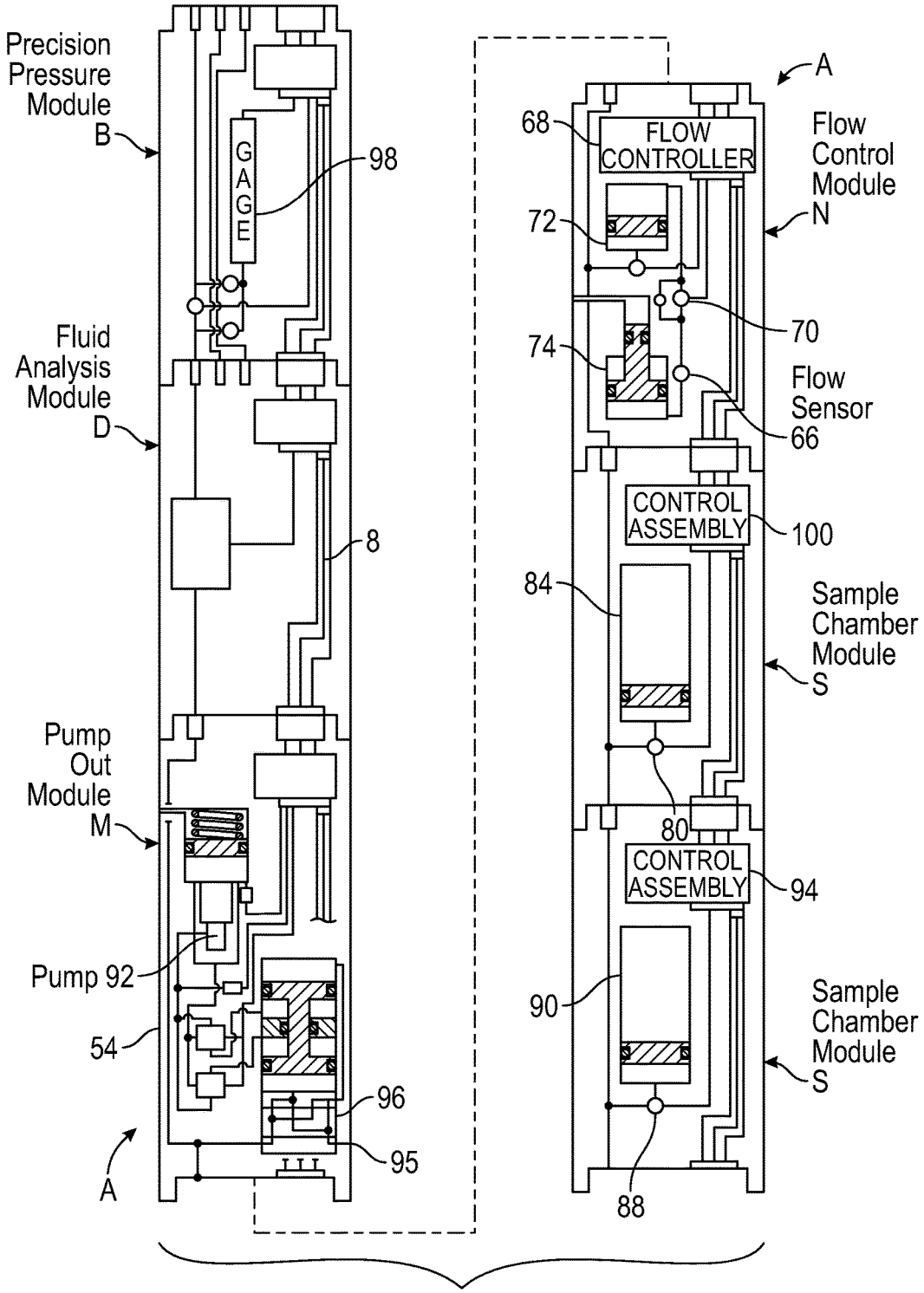
FIG. 2 is a schematic views of portions of an apparatus according to one or more aspects of the present disclosure.

The flow control module N includes a flow sensor 66, a flow controller 68 and a selectively adjustable restriction device, typically a valve 70. A predetermined sample size can be obtained at a specific flow rate by use of the equipment described above in conjunction with reservoirs 72 and 74. Having obtained a sample, sample chamber module S can be employed to store the sample taken in flow control module N. To accomplish this, a valve 80 is opened while valves 62, 62A and 62B are held closed, thus directing the sample just taken into a chamber 84 in sample chamber module S. The tool can then be moved to a different location and the process repeated. Additional samples taken can he stored in any number of additional sample chamber modules S which may be attached by suitable alignment of valves. For example, as shown in FIG. 2, there are two sample chambers S illustrated. After having filled the upper chamber by operation of valve 80, the next sample can be stored in the lowermost sample chamber module S by virtue of opening valve 88 connected to chamber 90. It should be noted that each sample chamber module has its own control assembly, shown in FIG. 2 as 100 and 94. Any number of sample chamber modules S or no sample chamber modules can be used in a particular configuration of the tool depending upon the nature of the test to he conducted.

As shown in FIG. 2, sample flow line 54 also extends through a precision pressure module B and a fluid analysis module D. The gauge 98 should preferably be mounted as close to probes 12, 14 or 46 to reduce internal piping which, due to fluid compressibility, may affect pressure measurement responsiveness. The precision gauge 98 is more sensitive than the strain gauge 58 for more accurate pressure measurements with respect to time. Gauge 98 can he a quartz pressure gauge which has higher static accuracy or resolution than a strain gauge pressure transducer. Suitable valving and control mechanisms can also be employed to stagger the operation of gauge 98 and gauge 58 to take advantage of their difference in sensitivities and abilities to tolerate pressure differentials.

Use of the packer module P allows a sample to be taken through inlet 64 by drawing formation fluid from a section of the well bore located between packers 28 and 30. This increased well bore surface area permits greater flow rates to be used without risk of drawing down the sample pressure to the bubble point of the formation fluid thus creating undesirable gas which affects the permeability test results.

The probe module F and multiprobe module F include a resistivity measurement device 56 which distinguishes, in water based muds, between filtrate and formation fluid when the fluid analysis module D is not included in the apparatus A. The valve 62 minimizes after flow when performing permeability determinations. The fluid analysis module D is designed to discriminate between oil, gas and water. By, virtue of its ability to detect gas, the fluid analysis module D can also be used in conjunction with the pump out module M to determine formation bubble point.

Figure 3:
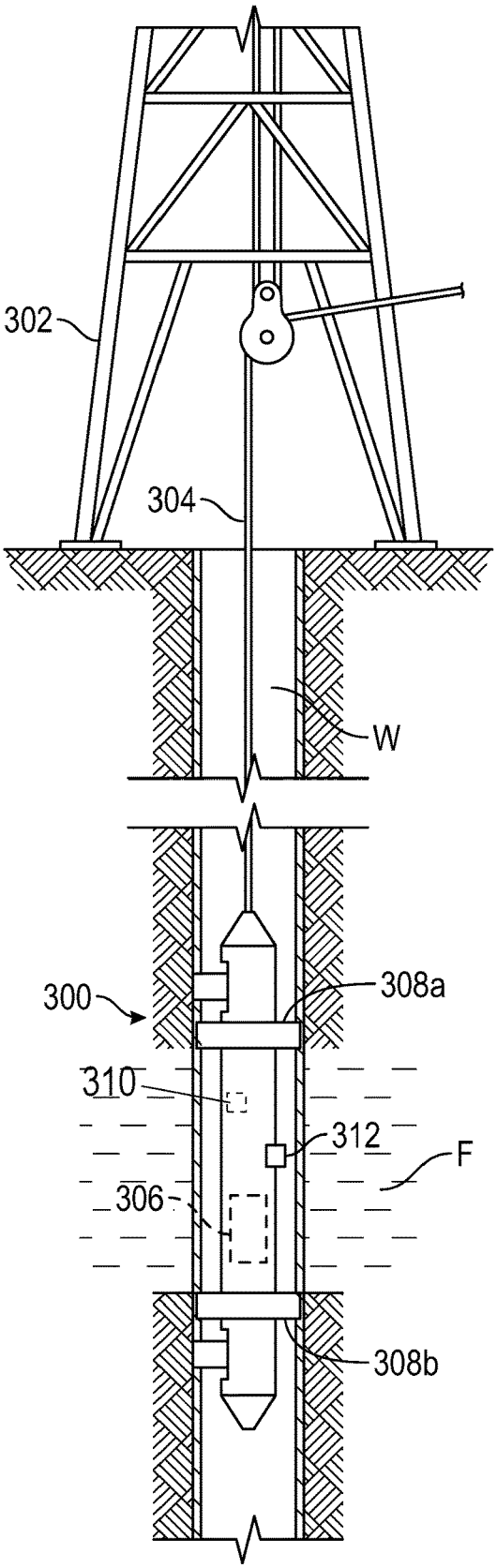
FIG. 3 is a schematic view of at least a portion of apparatus according to one or more aspects of the present disclosure.

FIG. 3 depicts a downhole tool 300 that may be used to perform DFA of the formation F according to one or more aspects of the present disclosure. The downhole tool 300 may be suspended in the wellbore W from a rig 302 via a multi-conductor cable 304. The downhole tool 300 includes a pump system 306 according to one or more aspects of the present disclosure. The downhole tool 300 may also include inflatable packers 308*a* and 308*b* configured to seal off or otherwise isolate a portion of the wellbore W. The downhole tool 300 also includes one or more probes, ports and/or other outlets 312 that may be utilized to obtain samples of fluid and to inject an external fluid into the isolated portion of the wellbore W within the interval sealed between the inflated packers 308*a* and 308*b*.

Figure 4:
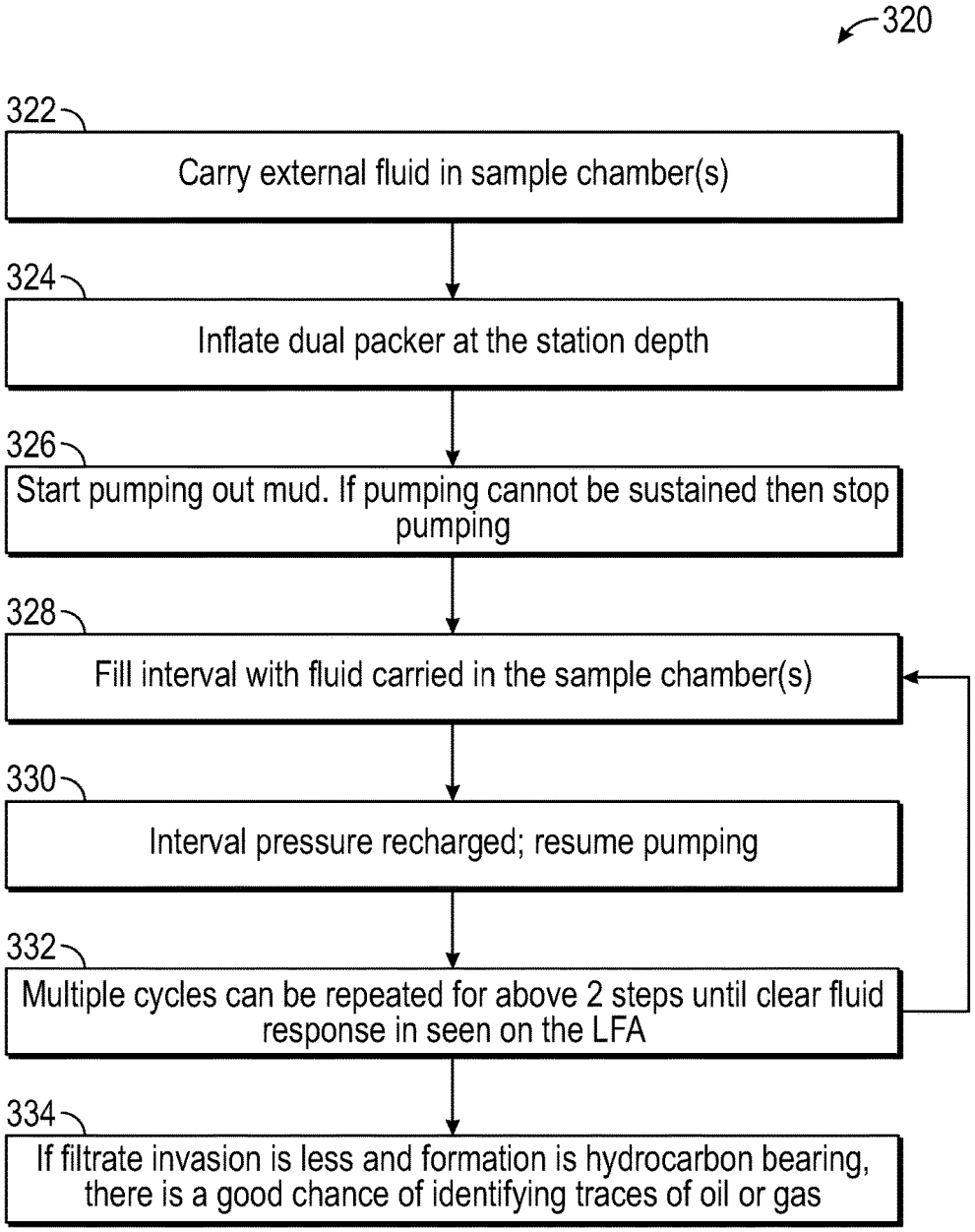
FIG. 4 illustrates an analysis method for downhole fluid analysis in accordance with an embodiment of the present techniques disclosed herein.

FIG. 4 illustrates an analysis method 320 for DFA in accordance with an embodiment of the present techniques disclosed herein. A first step includes carrying (block 322) an external fluid in one or more sample chambers (e.g., sample chambers 84 or 90 of FIG. 2) of the downhole tool (e.g., apparatus A of FIGS. 1 and 2 or downhole tool 300 of FIG. 3). The external fluid may be any fluid that is compatible with the mud present in the interval between the packers (e.g., straddle packers 28 and 30 of FIG. 1 or packers 308*a* and 308*b* of FIG. 3). For example, the external fluid may be water when the wellbore is drilled with WBM and the external fluid may be hydraulic oil (e.g., Univis J-26) when the wellbore is drilled with OBM or SOBM. As a further example, water is not used as the external fluid with OBM because it would be difficult to differentiate between the water of the external fluid and formation water. In certain embodiments, the external fluid may be water with a salinity approximately equal to a salinity of the mud filtrate, which enables differentiation between mud filtrate and formation water based on their different salinities. As described above, the downhole tool may include several sample chambers. As such, several of the sample chambers may carry the external fluid, while still leaving several sample chambers to be used for sample collection. In some embodiments, sample chambers that originally carried external fluid may be used for sample collection after being emptied of the external fluid. As discussed below, external fluid from more than one sample chamber may be used at a particular depth or station depending on the particular circumstances present there.

A second step includes inflating (block 324) the packers (e.g., straddle packers 28 and 30 of FIG. 1 or packers 308*a* and 308*b* of FIG. 3) at the selected station depth. The packers may be inflated using a variety of techniques as generally described above. For example, the packers may be inflated using formation fluid, hydraulic fluid, or other fluids. After the packers are inflated to a desired inflation pressure, the interval between the packers is sealed or isolated from the wellbore above and below the packers.

A third step includes pumping (block 326) out mud from the interval, such as by using the pump out module M of FIG. 1 or pump system 306 of FIG. 3. In particular, the mud may enter the inlet 64 of FIG. 1 or the outlet 312 of FIG. 3. The pumping out may continue until pumping by the pump out module can no longer be sustained, which may correspond to a particular condition. For example, the condition may correspond to a minimum inlet pressure requirement of the pump out module or a maximum differential pressure rating of the packer module or packers. In other words, continued pumping out below the minimum inlet pressure requirement of the pump out module may degrade operation of the pump out module. Similarly, continued pumping out above the maximum differential pressure rating of the packer module or packers may degrade the packer module or packers, or reduce the effectiveness of the sealing provided by the packers. After the condition is reached, then pumping by the pump out module may be stopped.

A fourth step includes filling (block 328) the interval with the external fluid carried in the one or more sample chambers. In particular, a pressure of the external fluid within the sample chambers is typically greater than a pressure of the interval. Thus, by opening the appropriate valves of the downhole tool, the external fluid may flow from the sample chambers and into the interval via the flow line 54 and inlet 64 of FIG. 1 or flow line and outlet 312 of FIG. 3 because of the pressure differential between the sample chamber and the interval. Accordingly, the interval is at least partially filled with the external fluid and the pressure of the interval increases as a result of the transfer of the external fluid.

A fifth step includes recharging (block 330) of the interval pressure by the transfer of the external fluid from the sample chamber to the interval. In certain embodiments, a pressure sensor (310) may be used to measure the interval pressure and the transfer of the external fluid may be stopped (e.g., by closing one or more valves of the downhole tool) once a predetermined interval pressure is reached. Thus, all or a portion of the external fluid from the sample chamber may be transferred to the interval depending on when the predetermined recharged interval pressure is reached. At this point (e.g., when the interval is recharged by the external fluid), pumping by the pump out module may resume.

A sixth step includes repeating (block 332) multiple cycles of recharging the interval pressure until a clear fluid response is seen by the fluid analysis module (e.g., fluid analysis module D of FIG. 2). As described below, a goal of the analysis method 320 is to improve detection of hydrocarbons from low mobility or tight reservoirs. As such, if the fluid analysis module fails to provide a clear fluid response (e.g., detection of hydrocarbons), then the fourth and fifth steps (blocks 328 and 330) may be repeated.

A seventh step includes identification (block 334) of traces of hydrocarbons (e.g., oil or gas) if the filtrate invasion is lessened by the present technique and the formation is hydrocarbon-bearing. After determining whether hydrocarbons are present at the station depth, the analysis method 320 may be repeated at another station depth.

Figure 5:
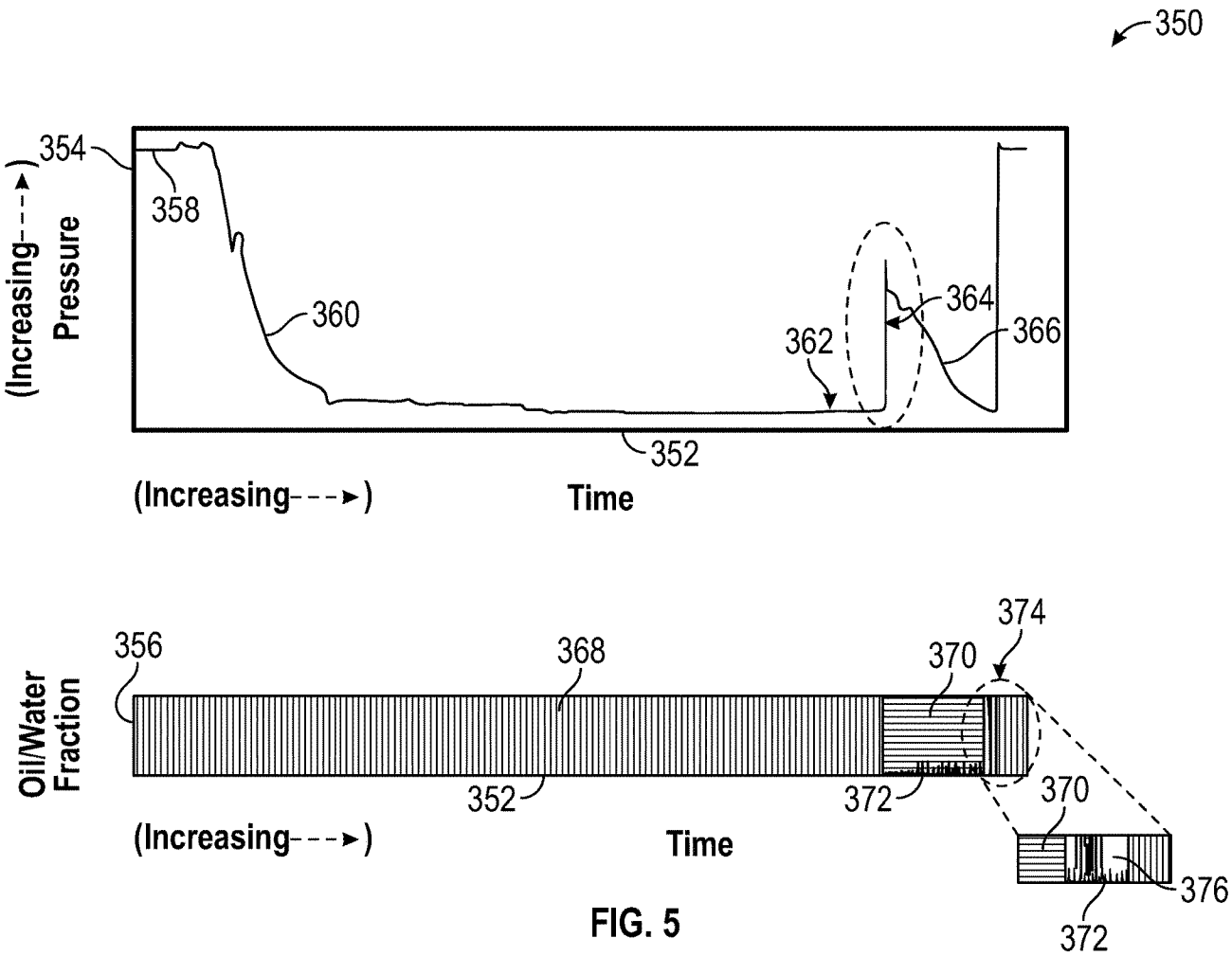
FIG. 5 depicts downhole fluid analysis results in accordance with an embodiment of the present techniques disclosed herein.

FIG. 5 depicts downhole fluid analysis results 350 in accordance with an embodiment of the present techniques disclosed herein. As shown in FIG. 5, the results are displayed on two charts that each include an x-axis 352 representing elapsed time. The upper chart includes a y-axis 354 representing pressure and the lower chart includes a y-axis 356 representing composition. In the results shown in FIG. 5, the y-axis 356 represents oil/water fraction, but in other embodiments, the y-axis may represent a composition of the oil, such as a breakdown of C1, C2, C3, C4, C5, and C6+ hydrocarbon components. Thus, as used herein, composition refers generally to a determination of the components of the formation fluid, such as oil, water, gas, or particular hydrocarbon components, as determined using a variety of techniques, such as optical fluid analysis. Referring first to the upper chart, the pressure response begins at 358 prior to pumping out the interval. Curve 360 represents the pressure decrease of the interval as the interval is pumped out. At 362, the pressure is essentially flat and has approached the minimum inlet pressure requirement of the pump out module. As such, the interval is recharged at 364 with the external fluid from the sample chamber. Curve 366 represents the resumed pumping out of the interval by the pump out module after recharging.

To see the effect of the disclosed technique, the lower chart shows that in zone 368, the fluid analysis module indicates a highly absorbing fluid flag caused by the presence of a large amount of solids during the initial pump out of the interval. In other words, the fluids analysis module is unable to detect the presence of any hydrocarbons. In contrast, in zone 370 the fluids analysis module indicates the presence of water and oil 372. Moreover, in zone 374 the fluid analysis module indicates the presence of gas 376, which may be more clearly seen in the zoomed-in view to the right of the lower chart. As such, by recharging the interval with the external fluid, the fluids analysis module is now able to accurately detect the presence of oil and gas that were not able to be detected prior to the recharging.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

What is claimed is:

1. A system, comprising:

a downhole tool, comprising:

a packer module, wherein the packer module comprises:

an upper packer and a lower packer configured to seal an interval of a wellbore in a geological formation; and an inlet disposed between the upper packer and the lower packer, wherein the inlet is configured to admit a formation fluid disposed in the interval into a flow line of the downhole tool;

a pump out module configured to pump the formation fluid from the inlet;

a fluid analysis module configured to analyze the formation fluid pumped to the fluid analysis module via the pump out module;

a sample module comprising a sample chamber containing an external fluid;

a flow line coupled to the packer module, pump out module, fluid analysis module, and sample module; and a data processing system configured to identify a composition of the formation fluid, wherein the data processing system comprises one or more tangible, non-transitory, machine-readable media comprising instructions to:

identify a condition indicating stopping the pump out module;

transfer the external fluid from the sample chamber to the interval via the flowline and the inlet;

resume pumping of the formation fluid from the inlet via the pump out module; and output the composition of the formation fluid;

wherein the external fluid comprises water when the wellbore is drilled with a water based mud (WBM) and the external fluid comprises hydraulic oil when the wellbore is drilled with an oil based mud (OBM) or synthetic oil based mud (SOBM).

2. The system of claim 1, wherein the downhole tool is configured for conveyance within the wellbore by at least one of a wireline or a drillstring.

3. The system of claim 1, wherein the downhole tool comprises a pressure sensor configured to sense a pressure of the interval.

4. A method, comprising:

placing a downhole tool in a wellbore in a geological formation, wherein the wellbore or the geological formation, or both, contain a formation fluid, and wherein the downhole tool comprises:

a packer module, wherein the packer module comprises:

an upper packer and a lower packer configured to seal an interval of the wellbore; and an inlet disposed between the upper packer and the lower packer, wherein the inlet is configured to admit the formation fluid disposed in the interval into a flow line of the downhole tool;

a pump out module configured to pump the formation fluid from the inlet;

a fluid analysis module configured to analyze the formation fluid pumped to the fluid analysis module via the pump out module;

a sample module comprising a sample chamber containing an external fluid; and a flow line coupled to the packer module, pump out module, fluid analysis module, and sample module;

performing downhole fluid analysis using the fluid analysis module to determine a composition of the formation fluid; and using a processor to:

identify a condition indicating that pumping by the pump out module is to be stopped, wherein the condition comprises a minimum inlet pressure requirement of the pump out module or a maximum differential pressure rating of the packer module;

stop pumping by the pump out module;

transfer the external fluid from the sample chamber to the interval via the flowline and the inlet;

resume pumping of the formation fluid from the inlet via the pump out module;

and output the composition of the formation fluid as determined by the fluid analysis module.

5. The method of claim 4, wherein the downhole tool comprises a pressure sensor configured to sense a pressure of the interval.

6. The method of claim 4, wherein the external fluid comprises water when the wellbore is drilled with a water based mud (WBM) and the external fluid comprises hydraulic oil when the wellbore is drilled with an oil based mud (OBM) or synthetic oil based mud (SOBM).

7. The method of claim 4 comprising using the processor to:

pump the formation fluid from the inlet via the pump out module, wherein the formation fluid comprises a first concentration of mud;

identify the condition indicating stopping the pump out module;

transfer the external fluid from the sample chamber to the interval via the flowline and the inlet;

resume pumping of the formation fluid from the inlet via the pump out module, wherein the formation fluid comprises a second concentration of mud less than the first concentration; and output the composition of the formation fluid.

8. The method of claim 4, wherein the external fluid is transferred from the sample chamber to the interval via a sample chamber pressure greater than an interval pressure.

9. The method of claim 4, comprising using the processor to:

determine that the composition of the formation fluid is inadequate after the transfer of the external fluid;

stop pumping by the pump out module;

transfer additional external fluid from the sample chamber or a second sample chamber to the interval via the flowline and the inlet;

resume pumping of the formation fluid from the inlet via the pump out module; and output the composition of the formation fluid as determined by the fluid analysis module.

10. The method of claim 4, wherein the geological formation comprises a low mobility zone.

11. One or more tangible, non-transitory, machine-readable media comprising instructions to:

receive at least one measurement representative of a formation fluid as analyzed by a downhole tool in a wellbore in a geological formation within a hydrocarbon reservoir, wherein the downhole tool comprises:

a packer module, wherein the packer module comprises:

an upper packer and a lower packer configured to seal an interval of the wellbore; and an inlet disposed between the upper packer and the lower packer, wherein the inlet is configured to admit the formation fluid disposed in the interval into a flow line of the downhole tool;

a pump out module configured to pump the formation fluid from the inlet;

a fluid analysis module configured to analyze the formation fluid pumped to the fluid analysis module via the pump out module;

a sample module comprising a sample chamber containing an external fluid; and a flow line coupled to the packer module, pump out module, fluid analysis module, and sample module;

identify a condition indicating that pumping by the pump out module is to be stopped;

stop pumping by the pump out module;

transfer the external fluid from the sample chamber to the interval via the flowline and the inlet;

resume pumping of the formation fluid from the inlet via the pump out module; and output the composition of the formation fluid as determined by the fluid analysis module;

wherein the external fluid comprises water when the wellbore is drilled with a water based mud (WBM) and the external fluid comprises hydraulic oil when the wellbore is drilled with an oil based mud (OBM) or synthetic oil based mud (SOBM).

12. The method of claim 11, wherein the downhole tool comprises a pressure sensor configured to sense a pressure of the interval.

13. The method of claim 11, wherein the condition comprises a minimum inlet pressure requirement of the pump out module or a maximum differential pressure rating of the packer module.

14. The method of claim 11, comprising using the processor to:

pump the formation fluid from the inlet via the pump out module, wherein the formation fluid comprises a first concentration of mud;

identify the condition indicating stopping the pump out module;

transfer the external fluid from the sample chamber to the interval via the flowline and the inlet;

resume pumping of the formation fluid from the inlet via the pump out module, wherein the formation fluid comprises a second concentration of mud less than the first concentration; and output the composition of the formation fluid.

15. The method of claim 11, wherein the external fluid is transferred from the sample chamber to the interval via a sample chamber pressure greater than an interval pressure.

16. The method of claim 11, comprising using the processor to:

determine that the composition of the formation fluid is inadequate after the transfer of the external fluid;

stop pumping by the pump out module;

transfer additional external fluid from the sample chamber or a second sample chamber to the interval via the flowline and the inlet;

resume pumping of the formation fluid from the inlet via the pump out module; and output the composition of the formation fluid as determined by the fluid analysis module.

17. The method of claim 11, wherein the geological formation comprises a low mobility zone.

* * * * *